US006235131B1

(12) United States Patent
Keihle et al.

(10) Patent No.: US 6,235,131 B1
(45) Date of Patent: May 22, 2001

(54) SYSTEM FOR HEAT TREATING COILED SPRINGS

(75) Inventors: Scott C. Keihle, Monticello; Ronald D. Orr, Logansport; Daniel R. Sebastian; Kenneth J. Schnettler, both of Peru, all of IN (US)

(73) Assignee: Mathew Warren Industries, Inc., Logansport, IN (US)

( * ) Notice: Subject to any disclaimer, the term of this patent is extended or adjusted under 35 U.S.C. 154(b) by 0 days.

(21) Appl. No.: 09/349,984

(22) Filed: Jul. 9, 1999

(51) Int. Cl.[7] ..... C21D 9/02; C22C 38/18

(52) U.S. Cl. ..... 148/580; 148/908; 148/566; 148/320; 148/333; 266/249

(58) Field of Search ..... 148/580, 908, 148/574, 575, 566, 320, 333; 266/249

(56) References Cited

U.S. PATENT DOCUMENTS 2,261,878 * 11/1941 Hathaway ..... 148/580

* cited by examiner

*Primary Examiner*—Deborah Yee
(74) *Attorney, Agent, or Firm*—Dickstein Shapiro Morin & Oshinsky LLP

(57) ABSTRACT

Steel springs are cold coiled, then hardened by electrical resistance heating, and then quenched. The invention may be used to produce hardened springs with uniform mechanical and physical characteristics, fine grain microstructures, and high fatigue resistance. The heat hardening process may be individually controlled for each spring, and it may be performed in a very short period of time. The process time may be so short as to preclude decarburization, making it unnecessary to use a controlled endothermic atmosphere. The free lengths of the finished springs may be controlled by applying axial forces during heat hardening. According to one aspect of the invention, the coiled central section of the spring is made harder than its ends. The equipment for practicing the invention may have a compact, uncomplicated construction.

30 Claims, 1 Drawing Sheet

SYSTEM FOR HEAT TREATING COILED SPRINGS

BACKGROUND OF THE INVENTION

1. Field of the Invention

The present invention relates generally to a system for heat treating coiled springs, such as steel automotive and truck suspension springs, brake springs, automotive power springs, and the like. The present invention also relates to a method and apparatus for resistance hardening coiled steel springs.

2. Discussion of the Related Art

Steel brake springs, suspension springs, and other automotive springs may be manufactured according to a "hot coil" process, an "annealed wire" process, or a "pre-tempered wire" process. In the hot coil process, straight steel bars are heated by natural gas or induction to a temperature in the range of from 1,600 to 1,900 degrees Fahrenheit (° F.). The hot bars are then coiled into the desired shape, then quenched in oil, and then tempered. The hot coil process may be used to produce straight-sided springs; it has not been used effectively to produce variable body diameter springs.

In the annealed wire process, steel springs are first cold formed and then austenitized, quenched and tempered. The austenitizing step may be performed in either a batch furnace or a continuous furnace. The steel may be heated to a temperature in the range of from 1,500 to 1,620° F. Unlike the hot coil process, the annealed wire process may be used to produce variable body diameter springs. The annealed wire process involves difficult material handling steps, however, and it may be subject to quality control problems. In particular, springs produced according to the annealed wire process may be subject to lot-to-lot inconsistency, decarburization, hardness non-uniformity, and distortion.

In the pre-tempered wire process, steel springs are cold coiled from pre-tempered wire. After coiling, the springs are stress relieved at a temperature in the range of from 700 to 800° F. In the pre-tempered wire process, the steel material is hardened before it is coiled. The pre-tempered wire process is not economical and has other disadvantages.

SUMMARY OF THE INVENTION

The disadvantages of the prior art are overcome to a great extent by the present invention. The present invention relates to a method of heat treating a coiled steel spring. According to one aspect of the invention, steel springs are cold coiled from annealed wire, then hardened by resistance heating, and then quenched.

According to another aspect of the invention, a spring is resistance heat hardened by applying electrical current through its opposite ends, and then the spring is quenched. Although the invention is described herein with reference to helical coiled springs, the invention is also applicable to spiral springs, torsion springs, and other structures.

The spring may be resistance heated to an austenitization temperature of at least 1,500° F. In a preferred embodiment, the spring is resistance heated to at least 1,600° F. The temperature employed may depend on the particular alloy composition of the spring and the microstructure and other characteristics desired for the finished product. In a preferred embodiment of the invention, the spring includes chromium and silicon, and the finished product has a ductile martensite fine grain microstructure.

An advantage of the invention is that the spring may be resistance hardened in a very short period of time. For example, the heating cycle may be completed in less than one hundred seconds. In a preferred embodiment of the invention, electrical current is applied to the spring for no more than about forty five seconds. The amount of applied electrical current may vary during the heating cycle. For example, the current may be reduced at the end of the heating cycle, after the spring achieves the desired high temperature.

According to another aspect of the invention, an axial force may be applied during the heating step to control the spring's free length. The axial force may be applied through the conductive end connectors. The connectors may be fixed at a desired spacing. Alternatively, the connectors may be moved axially by suitable actuators.

In a preferred embodiment of the invention, the quenching step is performed in an oil bath. The invention is not limited, however, to the preferred embodiment. Thus, other suitable quenching mediums, such as water, molten salt, etc., may be used if desired.

The present invention also relates to a resistance hardened steel spring. The spring may have a coiled section and opposite ends. The coiled section may be harder than the ends, especially where the ends of the spring are not subjected to as much active stress in use as the coiled section. In a preferred embodiment of the invention, the ends of the spring have hardnesses, measured on the Rockwell "C" (Rc) scale, in the range of from about 30 to 50 Rc. The coiled section may have a hardness greater than about 50 Rc.

The present invention may be used to heat harden a wide variety of springs, including springs with round cross sections, variable body diameters, and/or variable pitches.

In a preferred embodiment of the invention, a digital timer is used to control the flow of electrical current through the spring. If desired, the timer may apply variable amounts of current during each heating cycle. For example, the current may be reduced as the spring approaches or reaches the desired austenitizing temperature.

An object of the invention is to provide a manufacturing system that meets or exceeds the quality characteristics associated with the pre-tempered wire process and that is at least as economical as the annealed wire process.

Another object of the invention is to provide steel springs with improved material and mechanical characteristics, including but not limited to fine grain size and high fatigue resistance.

Another object of the invention is to provide a method of making coil springs with minimal distortion, uniform lengths, and uniform response to load characteristics.

Another object of the invention is to provide an uncomplicated heat hardening system that requires minimal set-up and processing time.

Another object of the invention is to provide a heat treatment process that can be easily controlled.

Another object of the invention is to provide a heat treatment system that has a compact construction and that occupies less factory floor space than prior art systems.

These and other features and advantages will become apparent from the following detailed description of preferred embodiments of the invention.

DETAILED DESCRIPTION OF PREFERRED EMBODIMENTS

Figure 1:
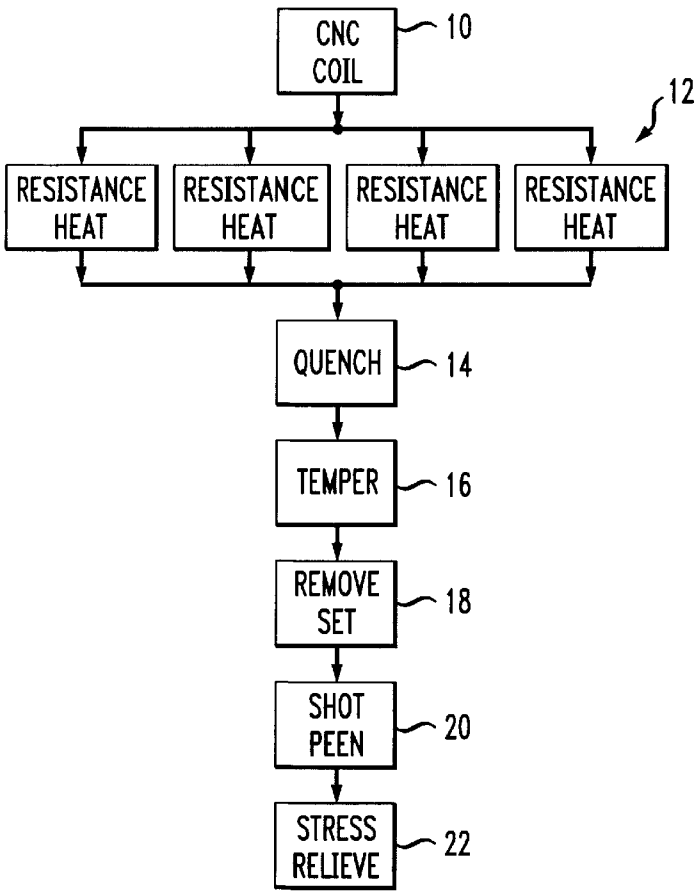
FIG. 1 is a flow chart of a spring manufacturing process constructed in accordance with a preferred embodiment of the present invention.

FIG. 1 illustrates a method of manufacturing springs in accordance with a preferred embodiment of the invention. According to the illustrated method, the springs (not shown in FIG. 1) are cold coiled from annealed chrome silicon steel wires (Step 10). The coiling step (Step 10) may be performed on a computer numerical control (CNC) machine, if desired. Then, the springs are austenitized by resistance heating (Step 12). The resistance heating step (Step 12) is discussed in more detail below.

Then, the springs are quenched in oil (Step 14). After the quenching step (Step 14), the springs have an untempered martensite microstructure. Next, the springs are tempered (Step 16) to a suitable hardness. The tempering step (Step 16) causes the springs to have a ductile tempered martensite microstructure. Subsequently, the springs are compressed (Step 18) to remove set and shot-peened (Step 20) to enhance life. Finally, the springs are stress relieved (Step 22).

Figure 2:
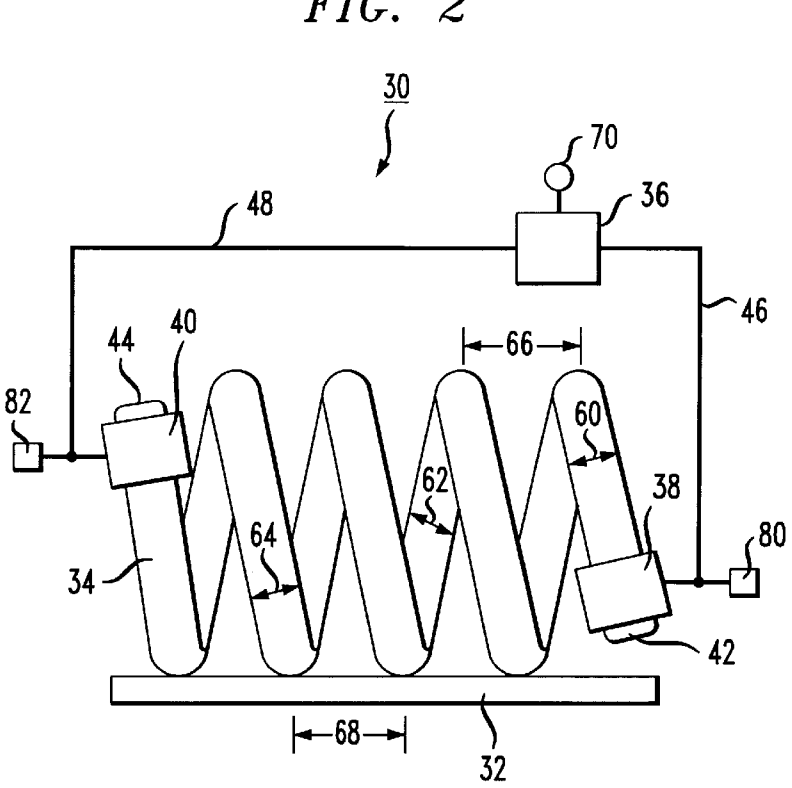
FIG. 2 is a side view of a resistance heating system for use in the manufacturing process of FIG. 1.

A resistance heating system 30 for use in the resistance heating step (Step 12) is shown in FIG. 2. The resistance heating system 30 has a support structure 32 for supporting a steel spring 34, a power source 36 for supplying electrical current, and connectors 38, 40 for applying the current to the opposite free ends 42, 44 of the spring 34. The connectors 38, 40 may be connected to the power source 36 by suitable insulated conductors 46, 48.

The spring 34 may be formed of a variety of steel materials and alloys. For example, as mentioned above, the spring 34 may be formed of a chrome silicon steel alloy. The present invention is especially well suited for manufacturing suspension springs, brake springs, and other heavy duty springs for trucks, automobiles, and the like. If desired, the spring 34 may be a variable body diameter spring. If desired, the spring 34 may be in the form of a hollow tube, with a diameter in the range of from two to five inches. The invention should not be limited, however, to the specific springs and other instrumentalities shown and described in detail herein.

The spring 34 may have a circular cross section along its length, although the invention is applicable to springs having other cross sections. The spring body diameter 60, 62, 64 may be variable. That is, the diameter 60, 62, 64 of the spring 34 may be different at different locations along its length. In the illustrated embodiment, the average spring body diameter 60, 62, 64 is about one-half inch. The invention should not be limited, however, to the illustrated embodiment. The pitch 66, 68 may also vary along the length of the spring 34. That is, the distance 66 between coils near one end 42 of the spring 34 may be different than the pitch 68 near the other end 44. The illustrated spring 34 may be about eleven inches long, for example, although the invention may be used to heat treat springs of a wide variety of lengths and sizes.

In operation, the power source 36 draws a high current through the spring 34. The current may be, for example, one hundred forty five amps. The electrical current causes the temperature within the spring 34 to increase rapidly. For example, the spring 34 may reach a temperature of 1,600° F. in thirty six seconds. The cycle time may be automatically controlled by a suitable timer 70. The current through the spring 34 may be reduced to sixty five amps at the end of the heating cycle, if desired.

The connectors 38, 40 may be formed of copper or another conductive material. Because of the conductivity of the connectors 38, 40, the ends 42, 44 of the spring 34 (including the portions of the spring 34 that are covered by the connectors 38, 40) are not heated to a high temperature. The spring ends 42, 44 are not austenitized or hardened with the rest of the spring 34. The ends 42, 44 remain in an annealed condition (low in hardness). In the illustrated embodiment, each annealed end 42, 44 may be about one and one-half inches long. The hardness of the ends 42, 44, measured on the Rockwell "C" (Rc) scale, may be from about 31 to 50 Rc without adversely affecting the performance of the spring 34.

The spring 34 may be designed for uses in which the ends 42, 44 are not subjected to active stresses. Consequently, the tendency of the system 30 to not harden the ends 42, 44 is not a problem. Indeed, the invention is especially well suited to heat treating coil springs with ends that are not subjected to active stresses in use (or that do not have stringent active stress requirements).

The load handling characteristics of the spring 34 are a function of its free length. To control the free length of the spring 34, axial tension or axial compression may be applied to the end connectors 38, 40 during the resistance heating process (Step 12). The connectors 38, 40 firmly grip the ends 42, 44 of the spring 34. Consequently, the free length of the spring 34 may be controlled by fixing the connectors 38, 40 at a desired spacing. Alternatively, tension or compression may be applied to the connectors 38, 40 by suitable actuators 80, 82. The actuators 80, 82 may be movably controlled by the timer 70, if desired.

An advantage of the invention is that it is easy to control the processing parameters (current, temperature, heating time, etc.) for the heating system 30. The system 30 handles each spring 34 individually. Consequently, tie system 30 may be used to produce a large number of finished springs with uniform material and physical characteristics. In addition, the resistance heating system 30 may be easily reconfigured to heat treat other, different springs according to a wide variety of temperatures, electrical currents, and cycle times.

Another advantage of the invention is that each spring can be rapidly heat treated. The heat treatment can be performed so quickly as to preclude decarburization, and the invention may be practiced without a controlled atmosphere around the spring 34. The rapid cycle time also prevents large grains from growing in the spring 34. Consequently, the invention may be used to produce springs with fine grain microstructures. The fine grain microstructure contributes to high fatigue resistance (long useful lives).

Another advantage of the invention is that it requires minimal floor space. Even though more than one heating system 30 may be used at the same time (four are represented schematically in FIG. 1), the invention may be practiced in one-third the floor space of prior art manufacturing systems.

EXAMPLE

Type 30 long stroke power springs (similar to automotive suspension springs) were constructed according to the method of FIG. 1 and subjected to a variety of tests. The test springs had variable body diameters (average wire diameter=0.526 inches) and a variable pitch. The test springs were produced from chrome silicon material per SAE 9254, resistance austenitized for a total of thirty six seconds, and oil quenched. The test springs were then tempered to final hardness in a tempering furnace, and then set removed, shot peened, and stress relieved.

The test springs were found to have suitable hardness and acceptable hardness variability. The test springs were found to have hardnesses in the range of from 59.0 to 61.2 Rc. The springs were also found to have a uniform martensite microstructure. No substantial decarburization was added to the test springs by the resistance heat treatment. The test springs exhibited an acceptably low amount of axial and radial distortion.

COMPARATIVE EXAMPLE

A continuous hardening furnace was heated by natural gas and maintained at a temperature of approximately 1,600° F. The atmosphere within the furnace was controlled by endothermic gas (also heated by natural gas). Comparison springs (the same type used to make the test springs) were transferred through the furnace on a continuous belt, and then were allowed to fall into a quench oil pit. The comparison springs were austenitized in the furnace for twenty to seventy four minutes. The temperature of the quench pit was maintained in the range of from 125 to 180° F. Then the comparison springs were conveyed out of the quench pit, through a washer (to remove the quench oil), and into a continuous tempering oven. The tempering oven was maintained at a temperature in the range of from 720 to 800° F.

The grain size of the test springs (ASTM grain size value=11 to 12) was much finer than that of the comparison springs (ASTM grain size value=8 to 9). The finer grain size is believed to be the result of the shorter austenitizing time used to harden the test springs. Grain growth generally increases with increased austenitizing time and temperature.

The test springs and the comparison springs were rapid cycle tested with a 2.400 inch stroke and the results were subjected to a statistical Weibull analysis. It was found that the cycle life of the test springs was over three hundred percent greater than that of the comparison springs. The increased cycle life (fatigue resistance) is believed to be due to the finer grain size of the test springs (the ones that were resistance hardened).

The above descriptions and drawings are only illustrative of preferred embodiments which achieve the features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

1. A method of heat treating a coiled steel spring, wherein said coiled steel spring has opposite free ends, said method comprising the steps of:

connecting conductive connectors to locations remote from said free ends of said coiled steel spring;

providing electrical heating to said coiled steel spring between said conductive connectors by applying electrical current through said conductive connectors; and subsequently, quenching said coiled steel spring.

2. The method of claim 1, wherein said heating step includes the step of increasing the temperature of said coiled steel spring to greater than 1,500° F.

3. The method of claim 2, further comprising the step of increasing the temperature of said coiled steel spring to a temperature of at least 1,600° F.

4. The method of claim 1, wherein said electrical current is applied through said connectors for no more than about one hundred seconds.

5. The method of claim 4, wherein said electrical current is applied through said conductive connectors for no more than about forty five seconds.

6. The method of claim 1, further comprising the step of applying an axial force to said coiled steel spring during said heating step to control the length of said coiled steel spring.

7. The method of claim 1, further comprising the step of automatically reducing the amount of electrical current applied through said conductive connectors.

8. The method of claim 1, wherein said coiled steel spring includes chromium and silicon.

9. A method of manufacturing hardened steel springs, wherein said steel springs have opposite ends, said method comprising the steps of:

connecting conductive connectors to locations remote from said ends of said steel springs;

providing electrical heating to said steel springs between said conductive connectors by applying electrical current through said conductive connectors; and subsequently, quenching said steel springs.

10. The method of claim 9, wherein said heating step includes the step of increasing the temperature of said steel springs to at least 1,600° F.

11. The method of claim 9, wherein said electrical current is applied through said connectors for no more than about one hundred seconds.

12. The method of claim 11, wherein said springs are quenched in oil.

13. A coiled steel spring comprising a coiled section and opposite ends, wherein said coiled section is hardened by electrical resistance heating, and wherein said coiled section is harder than said opposite ends.

14. The coiled steel spring of claim 13, wherein said opposite ends of said spring have Rockwell C hardnesses less than 50, and wherein said coiled section has a Rockwell C hardness greater than 50.

15. The coiled steel spring of claim 13, wherein said coiled section has a variable body diameter.

16. The coiled steel spring of claim 13, wherein said coiled section has a variable pitch.

17. A heat treatment apparatus, comprising:

a support for supporting a coiled steel spring having a pair of ends;

a source of electrical current;

electrically conductive connectors connected to the coiled steel spring at locations remote from the ends for applying the electrical current to the coiled steel spring between the conductive connectors, said conductive connectors being connected to said source of electrical current; and a quenching medium for quenching the coiled steel spring.

18. The heat treatment apparatus of claim 17, further comprising a timer for controlling the application of electrical current to the ends of the coiled steel spring.

19. The heat treatment apparatus of claim 18, wherein said timer is arranged to apply variable amounts of current to the coiled spring.

20. The heat treatment apparatus of claim 17, wherein said connectors are formed of copper.

21. The heat treatment apparatus of claim 17, further comprising means for applying axial force to the coiled steel spring to control the free length of the spring.

22. The method of claim 1, wherein said conductive connectors are connected to locations spaced from and proximate to said free ends.

23. The method of claim 1, wherein said electrical heating is sufficient to transform said coiled steel spring between said conductive connectors from an annealed state to an austenitized state.

24. The method of claim 23, wherein said electrical heating is insufficient to transform said free ends from an annealed state to an austenitized state.

25. The method of claim 9, wherein said conductive connectors are connected to locations spaced from and proximate to said ends.

26. The method of claim 9, wherein said electrical heating is sufficient to transform said coiled steel spring between said conductive connectors from an annealed state to an austenitized state.

27. The method of claim 26, wherein said electrical heating is insufficient to transform said ends from an annealed state to an austenitized state.

28. The heat treatment apparatus of claim 17, wherein said electrically conductive connectors are connected to locations spaced from and proximate to said free ends.

29. The method of claim 17, wherein said electrical heating is sufficient to transform said coiled steel spring between said conductive connectors from an annealed state to an austenitized state.

30. The method of claim 29, wherein said electrical heating is insufficient to transform said free ends from an annealed state to an austenitized state.

* * * * *